US009470118B2

(12) United States Patent
Kokubo et al.

(10) Patent No.: US 9,470,118 B2
(45) Date of Patent: Oct. 18, 2016

(54) VALVE TIMING CONTROL APPARATUS FOR INTERNAL COMBUSTION ENGINE AND CONTROLLER FOR VALVE TIMING CONTROL APPARATUS

(71) Applicant: HITACHI AUTOMOTIVE SYSTEMS, LTD., Hitachinaka-shi, Ibaraki (JP)

(72) Inventors: Naoki Kokubo, Hiratsuka (JP); Shinichi Kawada, Isehara (JP); Seiji Tsuruta, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 520 days.

(21) Appl. No.: 14/025,386

(22) Filed: Sep. 12, 2013

(65) Prior Publication Data

US 2014/0076253 A1 Mar. 20, 2014

(30) Foreign Application Priority Data

Sep. 19, 2012 (JP) ..... 2012-205135

(51) Int. Cl.

| | |
|---|---|
| ***G06F 7/00*** | (2006.01) |
| ***G06F 17/00*** | (2006.01) |
| ***F01L 1/344*** | (2006.01) |
| *F01L 1/46* | (2006.01) |

(52) U.S. Cl.

CPC ..... *F01L 1/344* (2013.01); *F01L 2001/34483* (2013.01); *F01L 2001/467* (2013.01); *F01L 2800/00* (2013.01); *F01L 2820/032* (2013.01)

(58) Field of Classification Search

CPC ..... F01L 1/344; F01L 2820/032; F01L 2001/34483; F01L 2001/467; F01L 2800/00

See application file for complete search history.

(56) References Cited

U.S. PATENT DOCUMENTS

| | | | | |
|---|---|---|---|---|
| 7,845,321 | B2 * | 12/2010 | Kobaishi | F01L 1/022 123/90.12 |
| 8,146,550 | B2 * | 4/2012 | Takemura | F01L 1/022 123/90.15 |
| 8,166,936 | B2 * | 5/2012 | Fujiyoshi | F01L 1/3442 123/90.15 |
| 8,457,864 | B2 * | 6/2013 | Takemura | F01L 1/3442 123/90.17 |
| 8,464,672 | B2 * | 6/2013 | Takemura | F01L 1/022 123/90.15 |
| 8,646,424 | B2 * | 2/2014 | Fujiyoshi | F01L 1/3442 123/90.17 |
| 9,004,025 | B2 * | 4/2015 | Shinomiya | F01L 1/3442 123/90.17 |
| 9,267,398 | B2 * | 2/2016 | Shiozawa | F01L 1/3442 |

FOREIGN PATENT DOCUMENTS

JP 2004-156508 A 6/2004

* cited by examiner

*Primary Examiner* — Mahmoud Gimie
*Assistant Examiner* — David Hamaoui
(74) *Attorney, Agent, or Firm* — Foley & Lardner LLP

(57) ABSTRACT

A valve timing control apparatus includes: an urging member to which a set load is provided to act, to the cam shaft, an urging force from one of the most retard angle position and the most advance angle position toward the intermediate phase position; and a controller configured to sense, as the intermediate phase position, a position at which a relative rotational speed between the driving rotational member and the cam shaft is varied by the relative rotation of the cam shaft beyond a region in which the cam shaft is controlled by the set load of the urging member, when the cam shaft is controlled to be relatively rotated from the one of the most retard angle position and the most advance angle position beyond the intermediate phase position.

18 Claims, 6 Drawing Sheets

VALVE TIMING CONTROL APPARATUS FOR INTERNAL COMBUSTION ENGINE AND CONTROLLER FOR VALVE TIMING CONTROL APPARATUS

BACKGROUND OF THE INVENTION

This invention relates to a valve timing control apparatus for an internal combustion engine which is configured to control opening and closing characteristics of an intake valve and an exhaust valve which are engine valves of the internal combustion engine, and a controller for the valve timing control apparatus.

In recent years, in a valve timing control apparatus arranged to vary valve timings of engine valves, there is a demand that a relative rotational position of cam shaft with respect to a timing sprocket is controlled in a retard angle direction and in an advance angle direction in accordance with an engine driving state, in addition to a valve timing which is optimum for a start of the engine.

Moreover, in a lift varying apparatus to vary a valve lift amount of an engine valve, there is a demand that the valve lift amount is increased or decreased with respect to the valve lift amount which is optimum for the start of the engine.

At the start of the engine, the valve timing of the intake valve needs to be held at an intermediate phase position between the most retarded angle position and the most advance angle position. Japanese Patent Application Publication No. 2004-156508 discloses a valve timing control apparatus arranged to control to the intermediate phase position which is optimum for the start of the engine.

SUMMARY OF THE INVENTION

By the way, the relative rotational position between the timing sprocket and the cam shaft is sensed, for example, based on information signals sensed by a crank angle sensor and a cam angle sensor. However, resolving powers of the sensors are decreased at the cranking of the engine since an engine speed is an extreme low speed. Accordingly, it is difficult to rapidly sense an accurate relative rotational position appropriate for the to start of the engine. Consequently, a response of the control may be decreased at the start of the engine, in particular, at the start of the engine cold state.

It is, therefore, an object of the present invention to provide a valve timing control apparatus of an internal combustion engine and a controller of the valve timing control apparatus which are devised to solve the above mentioned problems, and to accurately rapidly sense an intermediate phase position between a most retard angle position and a most advance angle position, which is appropriate for a start of the engine.

According to one aspect of the present invention, a valve timing control apparatus of an internal combustion engine comprises: a driving rotational member to which a rotational force is transmitted from a crank shaft; a cam shaft arranged to be rotated relative to the driving rotational member in accordance with a state of the engine from a most retard angle position to a most advance angle position through an intermediate phase position which is set between the most retard angle position and the most advance angle position, and which is appropriate for a start of the engine; an urging member to which a set load is provided to act, to the cam shaft, an urging force from one of the most retard angle position and the most advance angle position toward the intermediate phase position; and a controller configured to sense, as the intermediate phase position, a position at which a relative rotational speed between the driving rotational member and the cam shaft is varied by the relative rotation of the cam shaft beyond a region in which the cam shaft is controlled by the set load to of the urging member, when the cam shaft is controlled to be relatively rotated from the one of the most retard angle position and the most advance angle position beyond the intermediate phase position.

According to another aspect of the invention, a valve timing control apparatus of an internal combustion engine comprises: a driving rotational member to which a rotational force is transmitted from a crank shaft; a cam shaft arranged to be rotated relative to the driving rotational member in accordance with a state of the engine from a most retard angle position to a most advance angle position through an intermediate phase position which is set between the most retard angle position and the most advance angle position, and which is appropriate for a start of the engine, the cam shaft being relatively rotated by a first load from one of the most retard angle position and the most advance angle position toward the intermediate phase position, and being relatively rotated by a second load from the other of the most retard angle position and the most advance angle position toward the intermediate phase position, the first load being different from the second load, a controller configured to sense, as the intermediate phase position, a position at which a relative rotational speed between the driving rotational member and the cam shaft is varied by a difference between the first load and the second load of the relative rotation of the cam shaft, when the cam shaft is controlled to be relatively rotated from the one of the most retard angle position and the most advance angle position beyond the intermediate phase position.

According to still another aspect of the invention, a valve timing control apparatus of an internal combustion engine comprises: a driving rotational member to which a rotational force is transmitted from a crank shaft; a cam shaft arranged to be rotated relative to the driving rotational member in accordance with a state of the engine from a most retard angle position to a most advance angle position through an intermediate phase position which is set between the most retard angle position and the most advance angle position, and which is appropriate for a start of the engine; an urging member to which a set load is provided to act, to the cam shaft, an urging force from one of the most retard angle position and the most advance angle position toward the intermediate phase position; a crank angle sensor arranged to sense a rotational angle of the crank shaft; a cam angle sensor arranged to sense a rotational angle of the cam shaft; and a controller configured to sense, as the intermediate phase position, a position at which a relative rotational speed between the driving rotational member and the cam shaft is varied by the relative rotation of the cam shaft beyond a region in which the cam shaft is controlled by the set load of the urging member, when the cam shaft is controlled to be relatively rotated from the one of the most retard angle position and the most advance angle position at which the urging force of the urging member is acted, beyond the intermediate phase position.

BRIEF DESCRIPTION OF THE DRAWINGS

FIG. 4A shows a most retard angle position of a cam shaft. FIG. 4B shows an intermediate phase position of the cam shaft. FIG. 4C shows a most advance position of the cam shaft.

FIG. 8A shows a most retard angle position of the cam shaft. FIG. 8B shows an intermediate phase position of the cam shaft. FIG. 8C shows a most advance angle position of the cam shaft.

DETAILED DESCRIPTION OF THE INVENTION

Figure 1:
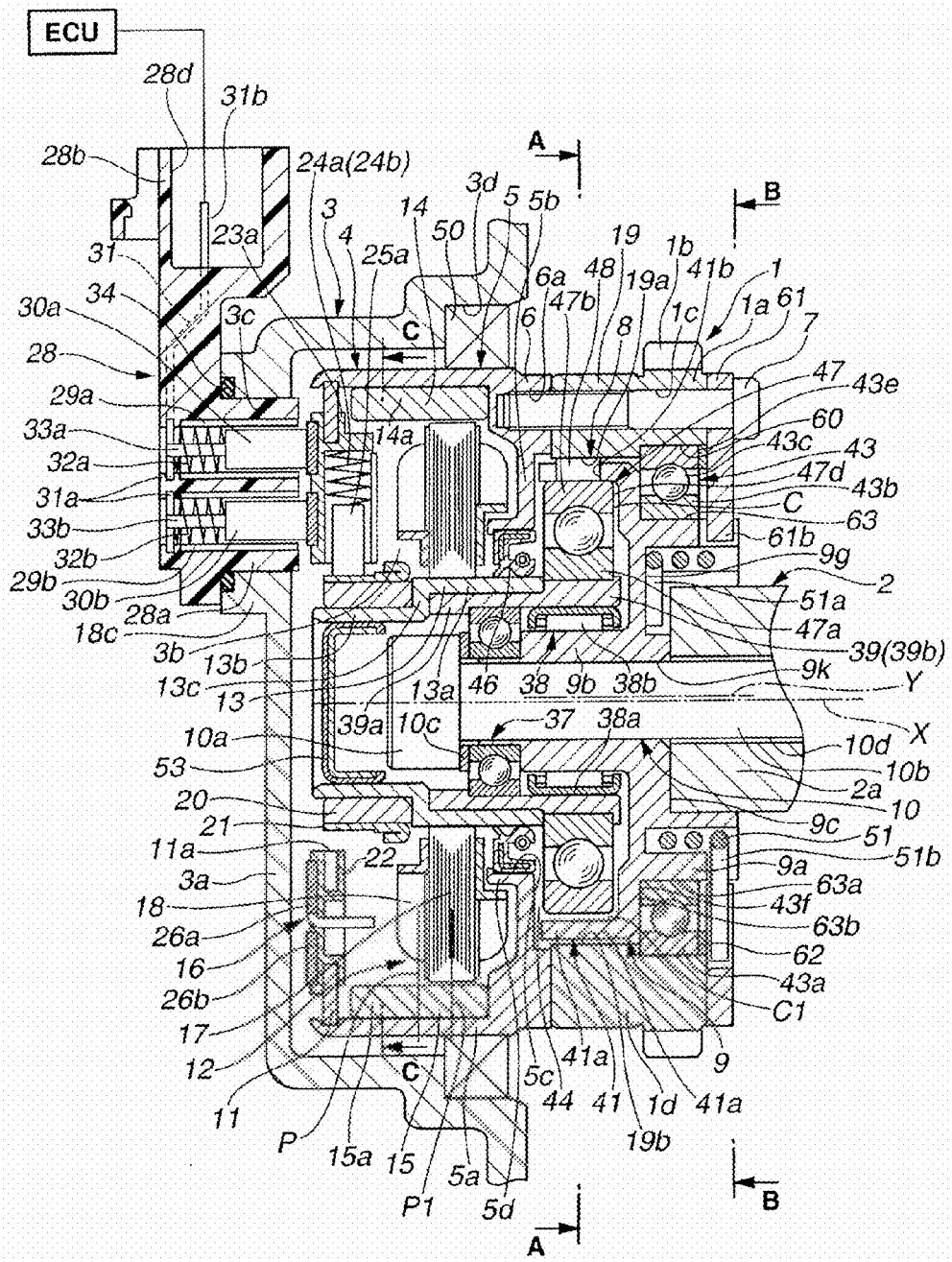
FIG. 1 is a longitudinal sectional view showing a valve timing control apparatus according to a first embodiment of the present invention.

Hereinafter, valve timing control apparatuses of an internal combustion engine according to embodiments of the present invention are illustrated with reference to the drawings. In this embodiments, the present invention is applied to a valve actuating apparatus of an intake side of the internal combustion engine. However, the present invention is applicable to a valve actuating apparatus of an exhaust side of the internal combustion engine.

As shown in FIGS. 1-4, this valve timing control apparatus (VTC) includes a timing sprocket 1 which is a driving rotational member which is rotationally driven by a crank shaft of the internal combustion engine; a cam shaft 2 which is rotationally supported on a cylinder head through a bearing (not shown), and which is rotated by the rotational force transmitted from timing sprocket 1; a cover member 3 which is fixed to a chain cover (not shown) disposed at a front position of timing sprocket 1; and a phase varying mechanism 4 which is disposed between timing sprocket 1 and cam shaft 2, and which is arranged to vary a relative rotational phase between timing sprocket 1 and cam shaft 2 in accordance with a driving state of the engine.

Timing sprocket 1 is wholly made from ferrous metal (iron-based metal material). Timing sprocket 1 has an integral annular shape. Timing sprocket 1 includes a sprocket main body 1*a* having an inner circumferential surface having a stepped shape; and a gear portion 1*b* which is integrally provided on an outer circumference of sprocket main body 1*a*, and which receives a rotational force from the crank shaft through a timing chain (not shown) wound around gear portion 1*b*; and an internal teeth forming (constituting) section 19 which is an internal teeth engagement portion, which is integrally provided on a front end side of sprocket 1*a*. Besides, gear portion 1*b* has an outer surface which is surface-treated by laser baking.

Moreover, in this timing sprocket 1, there is disposed a large diameter ball bearing 43 between sprocket main body 1*a* and a driven member 9 (described later) provided at a front end portion of cam shaft 2. With this, timing sprocket 1 and cam shaft 2 are supported to be relatively rotated.

This large diameter ball bearing 43 includes an outer wheel 43*a*, an inner wheel 43*b*, and balls 43*c* disposed between outer wheel 43*a* and inner wheel 43*b*. Outer wheel 43*a* of large diameter ball bearing 43 is fixed on an inner circumference side of sprocket main body 1*a*. Inner wheel 43*b* of large diameter ball bearing 43 is fixed on an outer circumference side of driven member 9.

Sprocket main body 1*a* includes an outer wheel fixing portion 60 which is formed on an inner circumference side by cutting, and which is an annular groove, and which is opened to the cam shaft 2's side.

This outer wheel fixing portion 60 is formed into a stepped shape. Outer wheel 43*a* of large diameter ball bearing 43 is press-fitted in outer wheel fixing portion 60 in the axial direction. Outer wheel fixing portion 60 positions an one axial side of outer wheel 43*a*.

Internal teeth forming section 19 is integrally formed on an outer circumference side of the front end portion of sprocket main body 1*a*. Internal teeth forming section 19 has a cylindrical shape protruding toward an electric motor 12 of phase varying mechanism 4. Internal teeth forming section 19 includes a plurality of internal teeth 19*a* which has a corrugation shape, and which is formed on an inner circumference of internal teeth forming section 19.

Figure 2:
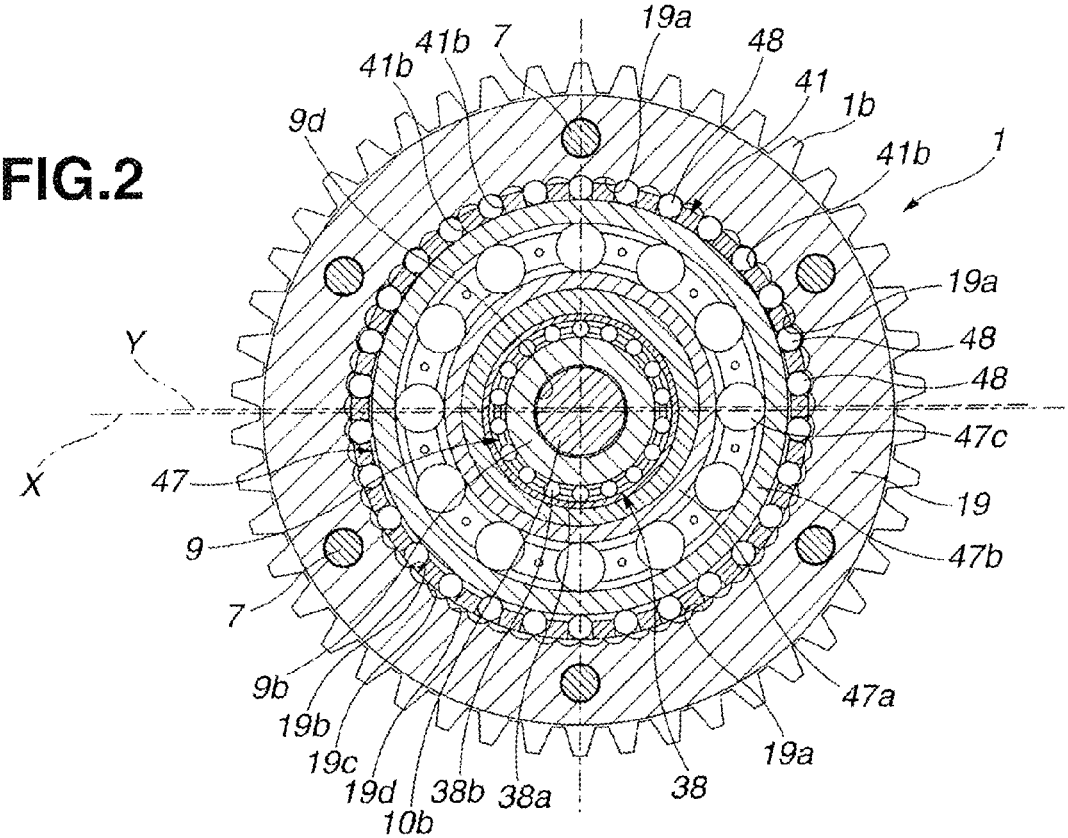
FIG. 2 is a sectional view taken along a section line A-A of FIG. 1.

As shown in FIG. 2, the plurality of internal teeth 19*a* are continuously formed at a regular interval in the circumferential direction. Each of internal teeth 19*a* includes a tooth tip 19*b* having an inversed V-shape (mountain-shape); both tooth surfaces 19*c* and 19*c* which are continuous with tooth tip 19*b*; and a tooth bottom surface 19*d* which is located between adjacent two of tooth surfaces 19*c* and 19*c*.

Moreover, in internal teeth forming section 19, tooth tips 19*b* and both tooth surfaces 19*c* and 19*c* of internal teeth 19*a* is baked by the laser. With this, these tooth tips 19*b* and both tooth surfaces 19*c* and 19*c* have a hardness higher than those of portions on the tooth bottom surface 19*d*'s side.

On a front end side of internal teeth forming section 19, there is disposed an internal screw forming section 6 which is an annular shape, and which is integral with a housing 5 (described later) of electric motor 12 to confront the front end side of internal teeth forming section 19.

Moreover, at a rear end portion of sprocket main body 1*a* which is opposite to internal teeth forming section 19, there is disposed an annular holding plate 61. This holding plate 61 is integrally formed from a metal sheet. As shown in FIG. 1 and FIGS. 4A-4C, holding plate 61 has an outside diameter substantially identical to an outside diameter of sprocket main body 1*a*, and an inside diameter which is set substantially equal to a diameter of a portion near substantially central portion of large diameter ball bearing 43 in the radial direction.

Figure 4A:
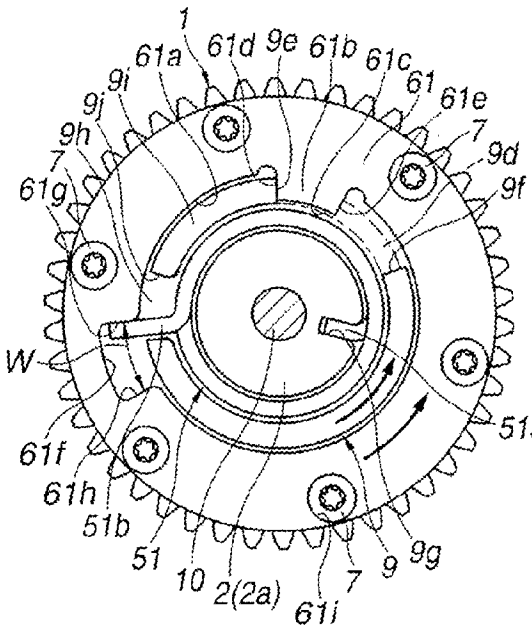
FIGS. 4A, 4B, and 4C are sectional views which are taken along a section line B-B of FIG. 1, and which show operation states of the valve timing control apparatus of FIG. 1.
Figure 4B:
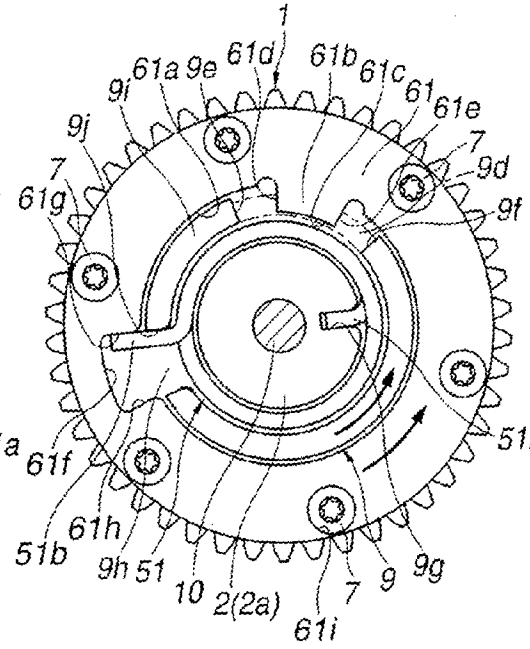
Figure 4C:
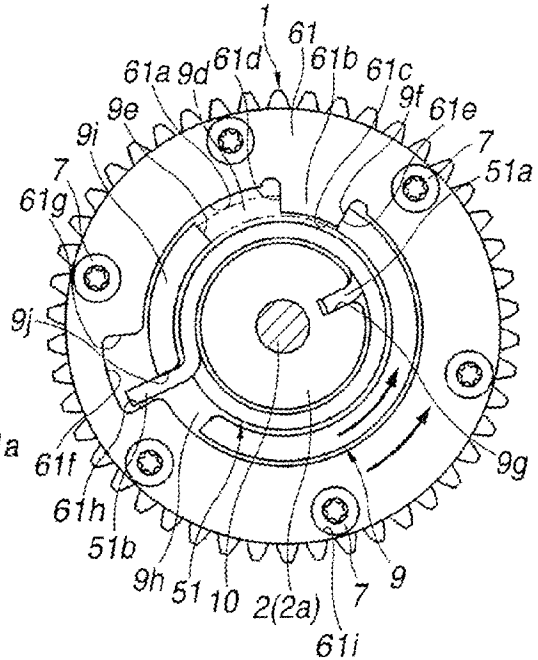

Accordingly, an inner circumference portion 61*a* of holding plate 61 is disposed to cover an axial outer end surface 43*e* of outer wheel 43*a* with a predetermined clearance. Moreover, holding plate 61 includes a stopper raised portion 61*b* which is integrally formed at a predetermined position of an inner circumference edge of inner circumference portion 61*a*, and which protrudes in the radially inside direction, that is, toward the central axis. As shown in FIGS. 4A-4C, this stopper raised portion 61*b* has a substantially sectorial shape. Stopper raised portion 61*b* includes a tip end edge 61*c* which has an arc shape (extending) along the outer circumference of torsion spring 51 (described later); and both side surfaces 61*d* and 61*e* which are restriction surfaces arranged to restrict a most retard angle position and a most advance angle position of cam shaft 2 by cooperating with both end edges 9*e* and 9*f* of arc hole 9*d* of driven member 9 (described later).

Holding plate 61 includes six bolt insertion holes 61*i* which are formed in the outer circumference portion of holding plate 61 at a regular interval in the circumferential direction, which penetrate through holding plate 61, and into which bolts 7 are inserted. On the other hand, holding plate 61 includes an engagement groove 61*f* which is formed in inner circumference portion 61*a* at a position pivoted 120 degrees from the stopper raised portion 61*b* in the advance angle direction, which has a sectorial shape, and into which second end portion 51*b* of torsion spring 51*b* of torsion spring 51 is engageably inserted.

This engagement groove 61*f* has a circumference width W set so that second end portion 51*b* of torsion spring 51 is elastically abutted on one end edge 61*g* of engagement groove 61*f* on the stopper raised portion 61*b*'s side from the circumferential direction at the most retard angle position of cam shaft 2 as shown in FIG. 4A, and so that second end portion 51*b* of torsion spring 51 is not abutted on (brought to a non-abutment state with) the other end edge 61*h* of engagement groove 61*f* when cam shaft 2 is relatively rotated to the most advance angle position as shown in FIG. 4C.

Moreover, there is disposed an annular spacer 62 between the inner surface of holding plate 61 and outer end surface 43*e* of outer wheel 43*a* of large diameter ball bearing 43 which confronts the inner surface of holding plate 61. This spacer 62 is arranged to apply a slight pressing force from holding plate 61 to outer end surface 43*e* of outer wheel 43*a* when holding plate 61 is fixed by bolts 7 by screwing together. This spacer 62 has a thickness set so that there is formed a minute clearance between outer end surface 43*e* of outer wheel 43*a* and holding plate 61, and which has a size of an allowable region of an axial movement of outer wheel 43*a*.

Sprocket main body 1*a* (internal teeth forming section 19) includes six bolt insertion holes 1*c* which are formed in an outer circumference portion of sprocket main body 1*a* at a substantially regular interval in the circumferential direction, and which penetrate through sprocket main body 1*a*. Holding plate 61 includes six bolt insertion holes 61*i* which are formed in an outer circumference portion of holding plate 61 at a substantially regular interval in the circumferential direction, and which penetrate through holding plate 61. Moreover, internal screw forming section 6 includes six internal screw holes 6*a* formed at positions corresponding to the positions of bolt insertion holes 1*c* and 61*i*. Timing sprocket 1, holding plate 61, and housing 5 are fixed together by screwing six bolts 7 inserted through internal screw holes 6*a* and bolt insertion holes 1*c* and 61*i*.

Sprocket main body 1*a* and internal teeth forming section 19 constitute a casing of a speed reduction mechanism 8 (described later).

Sprocket main body 1*a*, internal teeth forming section 19, holding plate 61, and internal screw forming section 6 have a substantially identical outside diameter.

Cover member 3 is made from aluminum alloy. Cover member 3 is formed into a cup shape. Cover member 3 includes a bulging portion 3*a* which is formed at a front end portion of cover member 3 to cover a front end portion of housing 5. Moreover, cover member 3 includes a cylindrical wall 3*b* which is integrally formed on an outer circumference portion side of bulging portion 3*a* to extend in the axial direction. This cylindrical wall 3*b* includes a holding hole 3*c* which is formed inside cylindrical wall 3*b* as shown in FIG. 1. An inner circumference surface of holding hole 3*c* constitutes a guide surface of a brush holding member 28 (described later).

Moreover, this cover member 3 includes six bolt insertion holes which are formed at a flange portion (not shown) formed in the outer circumference of cover member 3, and which penetrate through cover member 3. Cover member 3 is fixed to the chain cover by bolts (not shown) inserted into these bolt insertion holes of cover member 3.

Between an inner circumference surface of a stepped portion on the outer circumference side of bulging portion 3*a* and the outer circumference surface of housing 5, there is disposed a large diameter oil seal 50 which is a seal member, as shown in FIG. 1. This large diameter oil seal 50 has a substantially U-shaped cross section. A core metal is embedded within base material of a synthetic rubber. An annular base portion on the outer circumference side of oil seal 50 is mounted and fixed in a stepped annular portion 3*d* which is formed on the inner circumference surface of cover member 3.

Housing 5 includes a housing main body 5*a* which is a cylindrical portion that is formed into a bottomed cylindrical shape by press-forming the ferrous metal. Housing 5 is provided with a seal plate 11 which is made from a non-magnetic synthetic resin, and which seals (closes) the front end opening of housing main body 5.

Housing main body 5*a* includes a bottom portion 5*b* which is formed on the rear end side, and which has a circular plate shape; and a shaft portion insertion hole 5*c* which has a large diameter, which is formed at a substantially central portion of bottom portion 5*b*, and into which an eccentric shaft portion 39 is inserted; and an extension portion 5*d* which has a cylindrical shape, which is integrally formed at an edge of shaft portion insertion hole 5*c*, and which protrudes in the axial direction of cam shaft 2. Moreover, internal screw forming section 6 is integrally formed on the outer circumference side of the rear end surface of bottom portion 5*b*.

Cam shaft 2 includes two oval driving cams (not shown) which are provided to one cylinder, which are provided on the outer circumference surface of cam shaft 2, and which are arranged to open an intake valve (not shown). Cam shaft 2 includes a front end portion 2*a* to which driven member 9 is integrally connected by a cam bolt 10.

As shown in FIG. 1, cam bolt 10 includes a head portion 10*a*; a shaft portion 10*b*; an annular washer portion 10*c* which is disposed on an end surface of head portion 10*a* on the shaft portion 10*b*'s side; and an external screw portion 10*d* which is formed on an outer circumference of shaft portion 10*b*, and which is screwed into an internal screw portion formed inside cam shaft 2 from the end portion of cam shaft 2 in the axial direction.

Driven member 9 is integrally made from ferrous metal. As shown in FIG. 1, driven member 9 includes a fixing end portion 9*a* which is formed on the front end portion 2*a*'s side of cam shaft 2, and which is formed into a disc shape having a large thickness; a cylindrical portion 9*b* which protrudes from an inner circumference portion of a front end surface of fixing end portion 9*a* in the axial direction; and a cylindrical holding section (device) 41 which is integrally formed (provided) at the outer circumference portion of fixing end portion 9*a*, and which holds a plurality of rollers 48.

Fixing end portion 9*a* includes a cylindrical mounting groove 9*c* which is formed in a rear end portion of fixing end portion 9*a*, and in which front end portion 2*a* of cam shaft 2 is mounted. Fixing end portion 9*a* (Cam shaft 2) is fixed by pressurizing by an axial force of cam bolt 10 in the axial direction in a state in which front end portion 2*a* is mounted in mounting groove 9*c*. Besides, driven member 9 may be integrally formed with cam shaft 2.

As shown in FIGS. 4A-4C, fixing end portion 9*a* includes an arc hole 9*d* which is formed at a predetermined circumferential position, which penetrates through fixing end portion 9*a* in the radial direction, and in which the tip end side of stopper raised portion 61*b* is disposed. Both end edges 9*e* and 9*f* of this arc hole 9*d* are abutted on the corresponding both side surfaces 61*d* and 61*e* of stopper raised portion 61*b* in accordance with the relative rotation of cam shaft 2 so as to restrict the most retard angle position and the most advance angle position of cam shaft 2. Accordingly, arc hole 9*d* and stopper raised portion 61*b* constitutes a stopper mechanism.

Moreover, a torsion spring 51 which is an urging member is disposed in a cylindrical space formed on the inner circumference side of (radially inside) fixing end portion 9*a*.

This torsion spring 51 includes a first end portion 51*a* which is bent in the radially inside direction, and which is retained in a retaining groove 9*g* formed in fixing end portion 9*a* on the cylindrical portion 9*b*'s side from the radial direction as shown in FIG. 1 and FIG. 4. On the other hand, torsion spring 51 includes a second end portion 51*b* which is bent in the radially outside direction, and which is engageably inserted into engagement groove 61*f* of holding plate 61 through an insertion hole 9*h* formed at a predetermined position of fixing end portion 9*a*.

Torsion spring 51 is provided with a predetermined spring set load in the advance angle direction in a state in which second end portion 51*b* is elastically abutted on one end edge 61*g* of engagement groove 61*f* from the circumferential direction, that is, at the most retard angle position of cam shaft 2, as shown in FIG. 4A.

Moreover, when cam shaft 2 is rotated to a predetermined angle position (intermediate phase position) on the advance angle side as shown in FIG. 4B, end edge 9*j* of arc portion 9*i* of fixing end portion 9*a* is abutted on the base end side of second end portion 51*b* of torsion spring 51, so that the set load of torsion spring 51 is released in a further relative rotational region in the advance angle direction. That is, in this intermediate phase position, end edge 9*j* of arc portion 9*i* is abutted and supported on the base end side of second end portion 51*b* of torsion spring 51 in the circumferential direction. Until this time, the spring force of torsion spring 51 assists the rotational driving force of cam shaft 2 in the advance angle direction by electric motor 12 (described later).

As shown in FIG. 1, cylindrical portion 9*b* includes a bolt insertion hole 9*k* which is formed at a substantially central position of cylindrical portion 9*b*, which penetrates through cylindrical portion 9*b*, and into which shaft portion 10*b* of cam bolt 10 is inserted. Moreover, a needle bearing 38 is provided on the outer circumference side of cylindrical portion 9*b*.

As shown in FIGS. 1 and 2, holding section 41 is bent from the front end of the outer circumference portion of fixing end portion 9*a* to have a substantially L-shaped cross section. Holding section 41 has a bottomed cylindrical shape protruding in the direction identical to cylindrical portion 9*b*. A cylindrical tip end portion 41*a* of this holding section 41 extends through a space portion 44 which is an annular recessed portion formed between internal screw forming portion 6 and extension portion 5*d*, toward bottom portion 5*b* of housing 5. Moreover, tip end portion 41*a* includes a plurality of roller holding holes 41*b* each of which has a substantially rectangular shape, which are formed at a substantially regular interval in the circumferential direction, and which are roller holding portions that hold the plurality of rollers 48 so that rollers 48 are arranged to be rolled. A number of this roller holding holes 41*b* (rollers 48) is smaller than a number of internal teeth 19*a* of internal teeth forming section 19 by one.

An internal wheel fixing portion 63 is formed by cutting at a connection portion between the outer circumference portion of fixing end portion 9 and the bottom portion side of holding section 41. Internal wheel fixing portion 63 fixes internal wheel 43*b* of larger diameter ball bearing 43.

This internal wheel fixing portion 63 is formed by cutting into a stepped shape to confront outer wheel fixing portion 60 in the radial direction. Inner wheel fixing portion 63 includes an annular outer circumference surface 63*a* which extends in the axial direction of cam shaft 2; and a second fixing stepped surface 63*b* which is integrally formed at a position opposite to an opening of outer circumference surface 63*a*, and which extends in the radial direction. Inner wheel 43*b* of large diameter ball bearing 43 is press-fitted on outer circumference surface 63*a* in the axial direction. Moreover, an inner end surface 43*f* of the press-fitted internal wheel 43*b* is abutted on second fixing stepped surface 63*b* to position inner wheel 43*b* in the axial direction.

Phase varying mechanism 4 includes electric motor 12 which is an actuator disposed on the front end side of cam shaft 2 to be substantially coaxial with cam shaft 2; and speed reduction mechanism 8 which is arranged to reduce the rotational speed of electric motor 12, and to transmit the speed-reduced rotation to cam shaft 2.

Figure 3:
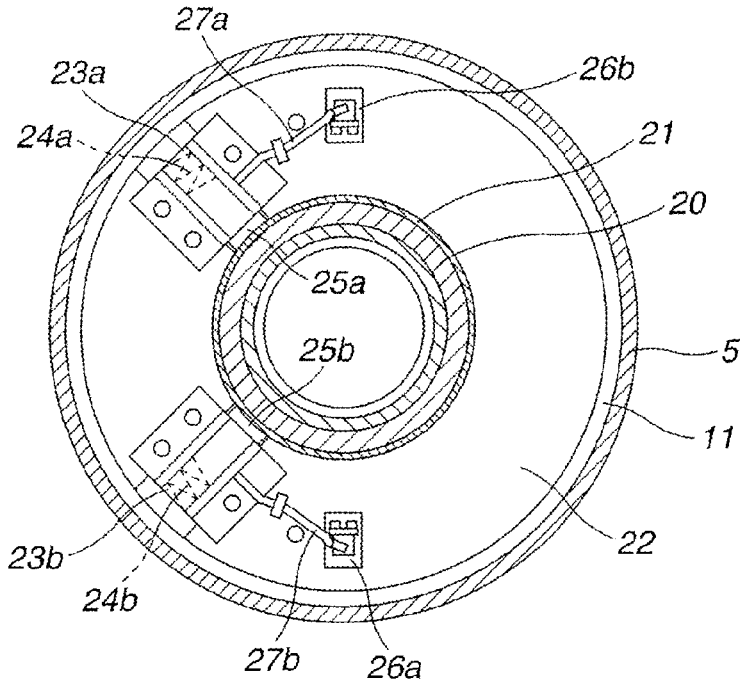
FIG. 3 is a sectional view taken along a section line C-C of FIG. 1.

As shown in FIGS. 1 and 3, electric motor 12 is a DC (direct-current) motor with a brush. Electric motor 12 includes housing 5 which is a yoke rotating as a unit with timing sprocket 1; a motor output shaft 13 which is an intermediate rotational member that is rotationally provided within housing 5; a pair of permanent magnets 14 and 15 which have half-arc shape, which are stators fixed on the inner circumference surface of housing 5; and a stator 16 which is fixed on sealing plate 11.

Motor output shaft 13 is formed into a stepped cylindrical shape. Motor output shaft 13 functions as an armature. Motor output shaft 13 includes a stepped portion 13*c* formed at a substantially central position in the axial direction; a large diameter portion 13*a* located on the cam shaft 2's side of stepped portion 13*c*; and a small diameter portion 13*b* which is located on the brush holding member 28's side of stepped portion 13*c*. Moreover, an iron core rotor 17 is fixed on the outer circumference of large diameter portion 13*a*. Eccentric shaft portion 39 is fixed in the inside of large diameter portion 13*a* by the press fit. An inner surface of stepped portion 13*c* positions eccentric shaft portion 39 in the axial direction. On the other hand, an annular member 20 is fixed on the outer circumference of small diameter portion 13*b* by the press fit. Moreover, a commutator 21 is fixed on an outer circumference surface of annular member 20 by the press fit in the axial direction. Commutator 21 is positioned in the axial direction by an outer surface of stepped portion 13*c*. Annular member 20 has an outside diameter substantially identical to the outside diameter of large diameter portion 13*a*. Moreover, annular member 20 has an axial length slightly smaller than the axial length of small diameter portion 13*b*.

Accordingly, it is possible to position eccentric shaft portion 39 and commutator 21 in the axial direction by the inner and outer surfaces of stepped portion 13*c*.

Consequently, it is possible to ease the assembling operation, and to improve the accuracy of the positioning.

Iron core rotor 17 is made from magnetic material having a plurality of magnetic poles. Iron core rotor 17 includes an outer circumference portion constituted as a bobbin having slots around which a coil wire of electromagnetic coil 18 is wound.

On the other hand, commutator 21 is formed into an annular shape from conductive material. Commutator 21 includes segments which are divided to have a number identical to a number of the magnetic poles of iron core rotor 17, and which are electrically connected with ends 18*c* of the coil wire pulled out from electromagnetic coil 18. That is, commutator 21 includes a folding portion (return portion) which is formed on the inner circumference side, and which sandwiches the tip ends of ends 18*c* of the coil wire to be electrically connected.

Permanent magnets 14 and 15 have a cylindrical overall shape. Each of permanent magnets 14 and 15 includes a plurality of magnetic poles in the circumferential direction. Permanent magnets 14 and 15 are positioned to be offset from the fixing position of iron core 17 in the forward direction.

That is, as shown in FIG. 1, permanent magnets 14 and 15 have a center P in the axial direction which is offset from a center P1 of iron core rotor 17 in the axial direction, by a predetermined distance in the forward direction, that is, permanent magnets 14 and 15 are disposed to be offset on the stator 16's side.

With this, front end portions 14*a* and 15*a* of permanent magnets 14 and 15 are disposed to be overlapped with commutator 21, first brushes 25*a* and 25*b* (described later) of stator 16 and so on in the radial direction.

As shown in FIG. 3, stator 16 includes a resin plate 22 which has a circular plate shape, which is integrally formed on the inner circumference side of (radially inside) seal plate 11; a pair of resin holders 23*a* and 23*b* which are provided inside resin plate 22; a pair of first brushes 25*a* and 25*b* which are received within resin holders 23*a* and 23*b* to be slid in the radial direction, and which are switching brushes (commutators) that have tip end surfaces elastically abutted on the outer circumference surface of commutator 21 in the radial direction by spring forces of coil springs 24*a* and 24*b*; inside and outside slip rings 26*a* and 26*b* which have an annular shape, which are embedded and fixed in the front end surface of resin holders 23*a* and 23*b* in a state where outer end surfaces of slip rings 26*a* and 26*b* are exposed; and pigtail harnesses 27*a* and 27*b* which electrically connect first brushes 25*a* and 25*b* and slip rings 26*a* and 26*b*. Besides, slip rings 26*a* and 26*b* constitute a part of a power feeding mechanism. First brushes 25*a* and 25*b*, commutator 21, pigtail harness 27*a* and 27*b* and so on constitute an energization switching to section.

Seal plate 11 is positioned and fixed in a recessed stepped portion formed in the inner circumference of the front end portion of housing 5 by caulking. Moreover, seal plate 11 includes a shaft insertion hole 11*a* which is formed at a substantially central position of seal plate 11, which penetrates through seal plate 11, and through which the one end portion of motor output shaft 13 and so on is inserted.

A brush holding member 28 is fixed to bulging portion 3*a*. Brush holding member 28 is a power feeding member which is integrally molded by the synthetic resin.

As shown in FIG. 1, this brush holding member 28 has an L-shape when viewed from a side. Brush holding member 28 mainly includes a cylindrical brush holding portion 28*a* which is inserted into holding hole 3*c*; a connector portion 28*b* which is formed at an upper end portion of brush holding portion 28*a*; a pair of bracket portions 28*c* and 28*c* which are integrally provided on the both sides of brush holding portion 28*a* to protrude, and which are fixed to bulging portion 3*a*; and a pair of terminal strips 31 and 31 whose most parts are embedded in brush holding member 28.

Each of the pair of terminal strips 31 and 31 is formed into a crank shape. The pair of terminal strips 31 and 31 are disposed in parallel with each other in the upward and downward directions. The pair of terminal strips 31 and 31 include first terminals 31*a* and 31*a* which are on the lower end side, which are disposed to be exposed on the bottom portion side of brush holding portion 28*a*; and second terminals 31*b* and 31*b* which are on the upper end side, and which are disposed to protrude within internal (female type) mounting groove 28*d* of connector portion 28. Moreover, second terminals 31*b* and 31*b* are electrically connected through a male terminal (not shown) to a battery power supply.

Brush holding portion 28*a* extends substantially horizontal direction (in the axial direction). Brush holding portion 28*a* includes cylindrical through holes formed at the upper and lower positions within brush holding portion 28*a*, and which sleeve-shaped sliding portions 29*a* and 29*b* are fixed in. Second brushes 30*a* and 30*b* are held within sliding portions 29*a* and 29*b* to be slid in the axial direction. Second brushes 30*a* and 30*b* have tip end surfaces abutted on slip rings 26*a* and 26*b* in the axial direction.

Each of second brushes 30*a* and 30*b* has a substantially rectangular shape. Second brushes 30*a* and 30*b* are urged, respectively, toward slip rings 26*a* and 26*b*, by spring forces of second coil springs 32*a* and 32*b* which are urging members elastically mounted between second brushes 30*a* and 30*b* and first terminals 31*a* and 31*a* on the bottom portion side of the through holes.

A pair of pigtail harnesses 33*a* and 33*b* having flexibility are fixed by welding between the front end portions of second brushes 30*a* and 30*b* and first terminals 31*a* and 31*a* so as to electrically connect second brushes 30*a* and 30*b* and first terminals 31*a* and 31*a*. This pigtail harnesses 33*a* and 33*b* have lengths set so as to restrict maximum sliding positions of second brushes 30*a* and 30*b* so as not to be dropped out from sliding portions 29*a* and 29*b* when second brushes 30*a* and 30*b* are maximally moved in the forward direction (in the rightward direction) by coil springs 32*a* and 32*b*.

An annular seal member 34 is mounted and held in an annular mounting groove formed in an outer circumference of the base end side of brush holding portion 28*a*. With this, when brush holding portion 28*a* is inserted into holding hole 3*c*, seal member 34 is elastically abutted on the tip end surface of cylindrical wall 3*b* so as to seal the inside of brush holding portion 28.

In connector portion 28*b*, second terminals 31*b* and 31*b* extend within mounting groove 28*d* into which the male terminals (not shown) are inserted from the upper end portion. Second terminals 31*b* and 31*b* are electrically connected through the male terminals to a control unit (ECU) (not shown) which is a controller.

Each of bracket portions 28*c* and 28*c* is formed into a substantially triangular shape. Bracket portions 28*c* and 28*c* include, respectively, bolt insertion holes 28*e* and 28*e* which are formed in both side portions of bracket portions 28*c* and 28*c*, and which penetrate through bracket portions 28*c* and 28*c*. Bolts screwed into a pair of internal screw holes (not shown) formed in bulging portion 3*a* are inserted into bolt insertion holes 28*e* and 28*e* so that brush holding member 28 is fixed to bulging portion 3*a* through bracket portions 28*c* and 28*c*.

Motor output shaft 13 and eccentric shaft portion 39 are rotatably supported by a small diameter ball bearing 37 provided on the outer circumference surface of shaft portion 10*b* on the head portion 10*a*'s side of cam bolt 10, and needle bearing 38 which is provided on the outer circumference surface of cylindrical portion 9*b* of driven member 9, and which is disposed on an axial side portion of small diameter ball bearing 37. These small diameter ball bearing 37 and needle bearing 38 constitute a bearing mechanism.

Needle bearing 38 includes a cylindrical retainer 38*a* which is press-fitted in the inner circumference surface of eccentric shaft portion 39; and needle rollers 38*b* which are plurality of rolling members that are rotatably held within retainer 38*a*. Needle rollers 38*b* are arranged to be rolled on the outer circumference surface of cylindrical portion 9*b* of driven member 9.

Small diameter ball bearing 37 includes an inner wheel sandwiched and fixed between the front end edge of cylindrical portion 9*b* of driven member 9, and washer portion 10*c* of cam bolt 10; and an outer wheel positioned and supported in the axial direction between a stepped portion formed in an inner circumference of motor output shaft 13, and a snap ring 45 which is a retaining ring.

An oil seal 46 having a small diameter is provided between an outer circumference surface of motor output shaft 13 (eccentric shaft portion 39) and an inner circumference surface of extension portion 5*d* of housing 5. Oil seal 46 is arranged to prevent the leakage of the oil from the inside of speed reduction mechanism 8 into electric motor 12. This oil seal 46 separates electric motor 12 and speed reduction mechanism 8. An inner circumference portion of oil seal 46 is elastically abutted on the outer circumference surface of motor output shaft 13. With this, oil seal 46 applies frictional resistance to the rotation of motor output shaft 13.

The control unit senses a current engine driving state based on information signals from various sensors such as a crank angle sensor, a cam angle sensor, an air flow meter, a water temperature sensor, an accelerator opening sensor (not shown) which are common (general), and controls the engine. Moreover, the control unit senses a relative rotational position of timing sprocket 1 and cam shaft 2 which are outputted from the crank angle sensor and the cam angle sensor, and controls the rotation of motor output shaft 13 by energizing electromagnetic coil 18 so as to control a relative rotational phase of cam shaft 2 with respect to timing sprocket 1 through speed reduction mechanism 8. In particular, the control unit is configured to increase and decrease a supply current amount with respect to electromagnetic coil 18 in accordance with a rotational driving load acted to electric motor 12.

Moreover, the control unit senses the variation of the rotational driving force by the driving load acted to electric motor 12 generated during the relative rotation of cam shaft 2 (described later), in addition to information of the relative rotational position of the cam shaft from the crank angle sensor and the cam angle sensor, and senses an intermediate phase position of cam shaft 2 with respect to timing sprocket 1 by this variation.

As shown in FIG. 1, speed reduction mechanism 8 includes eccentric shaft portion 39 which performs the eccentric rotational movement; a middle diameter ball bearing 47 which is provided on an outer circumference of eccentric shaft portion 39; rollers 48 which are provided on an outer circumference of middle diameter ball bearing 47; holding section 41 which allows the movement of rollers 48 in the radial direction while holding rollers 48 in the rolling direction; and driven member 9 which is integrally provided with holding section 41.

Eccentric shaft portion 39 is formed into a stepped cylindrical shape. Eccentric shaft portion 39 includes a small diameter portion 39*a* which is provided on a front end side, and which is fixed to an inner circumference surface of large diameter portion 13*a* of motor output shaft 13 by the press fit; and a large diameter portion 39*b* which is provided on the rear end side. Large diameter portion 39*b* of eccentric shaft portion 39 includes a cam surface which is formed on an outer circumference of large diameter portion 39*b*, and which has a shaft center Y that is slightly eccentric from a shaft center X of motor output shaft 13 in the radial direction. Middle diameter ball bearing 47, rollers 48 and so on constitute a planetary engagement portion.

The entire of ball bearing 47 is disposed to be overlapped with needle bearing 38 in the radial direction. Middle ball bearing 47 includes an inner wheel 47*a*; an outer wheel 47*b*; and balls 47*c* disposed between inner wheel 47*a* and outer wheel 47*b*. Inner wheel 47*a* is fixed to an outer circumference surface of eccentric shaft portion 39 by the press fit. On the other hand, outer wheel 47*b* is not fixed in the axial direction to be in a free state. That is, this outer wheel 47*b* includes one end surface which is on the electric motor 12's side in the axial direction, and which is not contacted on any portions; and the other end surface 47*d* which is on the opposite side in the axial direction, and which is in a free state to have a minute first clearance C between the other end surface 47*b* and an inner side surface of holding section 41 confronting the other end surface 47*d*. Moreover, the outer circumference surfaces of rollers 48 are abutted on the outer circumference surface of outer wheel 47*b* to be rolled on the outer circumference surface of outer wheel 47*b*. Furthermore, there is formed an annular second clearance C1 radially outside outer wheel 47*b*. By this second clearance C1, the entire of middle diameter ball bearing 47 is arranged to be moved in the radial direction, that is, to be moved to be eccentric, in accordance with the eccentric rotation of eccentric shaft portion 39.

Rollers 48 are made from ferrous metal. Rollers 48 are arranged to be fit in (engaged with) internal teeth 19*a* of internal teeth constituting section 19 while moving in the radial direction in accordance with the eccentric movement of middle diameter ball bearing 47. Moreover, rollers 48 are swung in the radial direction while being guided by the both side edges of roller holding holes 41*b* of holding section 41 in the circumferential direction.

As shown in FIG. 1, a cap 53 having a substantially U-shaped cross section is fixed to an inside of a front end of motor output shaft 13 by the press fit. Cap 53 closes a space on the cam bolt 10's side.

[Functions and Effects of First Embodiment]

Hereinafter, functions of the valve timing control apparatus according to this embodiment are illustrated. First, when the crank shaft of the engine is rotationally driven, timing sprocket 1 is rotated through the timing chain. This rotational force of timing sprocket 1 synchronously rotates housing 5, that is, electric motor 12, through inner teeth constituting section 19 and internal screw forming section 6. On the other hand, the rotational force of internal teeth forming section 19 is transmitted from rollers 48 through holding section 41 and driven member 9 to cam shaft 2. With this, the cams of cam shaft 2 actuates the intake valves to be opened and closed.

In the predetermined engine driving state after the engine start, the control unit energizes electromagnetic coil 18 of electric motor 12 from terminal strips 31 and 31 through pigtail harnesses 32*a* and 32*b*, second brushes 30*a* and 30*b*, slip rings 26*a* and 26*b* and so on. With this, motor output shaft 13 is rotationally driven, the speed of this rotational force of motor output shaft 13 is reduced by speed reduction mechanism 8, and the speed-reduced rotational force is transmitted to cam shaft 2.

That is, when eccentric shaft portion 39 is eccentrically rotated in accordance with the rotation of motor output shaft 13, each of rollers 48 crosses over and across one of internal teeth 19*a* of internal teeth forming section 19 at one rotation of motor output shaft 13 while being guided by one of roller holding holes 41*b* of holding section 41 in the radial direction, and rolls and moves to the other of internal teeth 19*a* which is adjacent to the one of internal teeth 19*a*. This movement is repeated, and rollers 48 are abuttably rolled on in the circumferential direction. With this, the rotational force is transmitted to driven member 9 while the speed of the rotation of motor output shaft 13 is reduced by this abuttably rolling movement of rollers 48. It is possible to arbitrary set the speed reduction ratio at this time by the number of rollers 48 and so on.

With this, cam shaft 2 is rotated in the positive direction or in the reverse direction relative to timing sprocket 1, and the relative rotational phase is converted. Accordingly, the opening and closing timing of the intake valve is controlled to be converted to the advance angle side or the retard angle side.

The maximum position (angle position) of the rotation of cam shaft 2 relative to timing sprocket 1 in the positive direction and in the reverse direction is restricted by abutting on one of side edges 9*e* and 9*f* of arc hole 9*d* of driven member 9 on one of side surfaces 61*d* and 61*e* of stopper raised portion 61*b*.

In particular, when driven member 9 is rotated in a direction opposite to the rotational direction of timing sprocket 1 as shown in FIG. 4A, one end edge 9*e* of arc hole 9*d* is abutted on one side surface 61*d* of stopper raised portion 61*b* to restrict the further rotation of driven member 9 in the above-described direction. With this, the relative rotational phase of cam shaft 2 relative to timing sprocket 1 is maximally varied to the retard angle side (the most retard angle side).

On the other hand, when driven member 9 is rotated in a direction (a direction shown by an arrow) identical to the rotational direction of timing sprocket 1 as shown in FIG. 4C, the other end edge 9*f* of arc hole 9*d* is abutted on the other side surface 61*e* of stopper raised portion 61*b* to restrict the further rotation of driven member 9 in the above-described direction. With this, the relative rotational phase of cam shaft 2 relative to timing sprocket 1 is maximally varied to the advance angle side (the most advance angle side).

Consequently, the opening and closing timing of the intake valve is maximally converted to the advance angle side or the retard angle side (the most advance angle side or the retard angle side). Accordingly, it is possible to improve the fuel consumption and the output of the engine.

The control unit basically senses the relative rotational position of cam shaft 2 relative to timing sprocket 1 by the angle information signal from the above-described normal crank angle sensor and the above-described normal cam angle sensor. In particular, the control unit senses the intermediate phase position which is appropriate for the engine start, by a timing at which the spring set load of torsion spring 51 is released.

That is, when cam shaft 2 is positioned at the most retard angle position relative to timing sprocket 1 as shown in FIG. 4A, the spring set load of torsion spring 51 is applied to cam shaft 2 through driven member 9 as described above. Accordingly, the spring force in the advance angle direction is acted to cam shaft 2.

Accordingly, when cam shaft 2 is relatively rotated from this state in the advance angle direction (in the leftward rotational direction in the drawing) by the rotational driving force of electric motor 12, the spring force of torsion spring 51 is acted as the assist force. Consequently, electric motor 12 can relatively rotate cam shaft 2 by the small rotational driving force. That is, the small amount of the current is supplied from the control unit.

Then, when cam shaft 2 is relatively rotated in the advance angle direction to the predetermined intermediate position as shown in FIG. 4B, end edge 9*j* of arc portion 9*i* of driven member 9 is abutted and supported on second end portion 51*b* of torsion spring 51 in the circumferential direction to separate (detach) second end portion 51*b* from end edge 61*g* of engagement groove 61*f*. With this, the assist spring force of torsion spring 51 to cam shaft 2 in the advance angle direction is released.

Then, when cam shaft 2 is further rotated in the advance angle direction, the driving load of electric motor 12 becomes large from a timing at which the assist force by torsion spring 51 is released. Accordingly, the speed of the relative rotation of cam shaft 2 is instantaneously decreased. Consequently, the supply amount of the current from the control unit to electromagnetic coil 18 is increased, so that the rotational driving force is suddenly increased. Cam shaft 2 is relatively rotated only by the rotational driving force of electric motor 2 until cam shaft 2 is restricted to the most advance angle position shown in FIG. 4C.

Besides, the spring force of torsion spring 51 is larger than the average value of the alternating torque generated in cam shaft 2.

Figure 5:
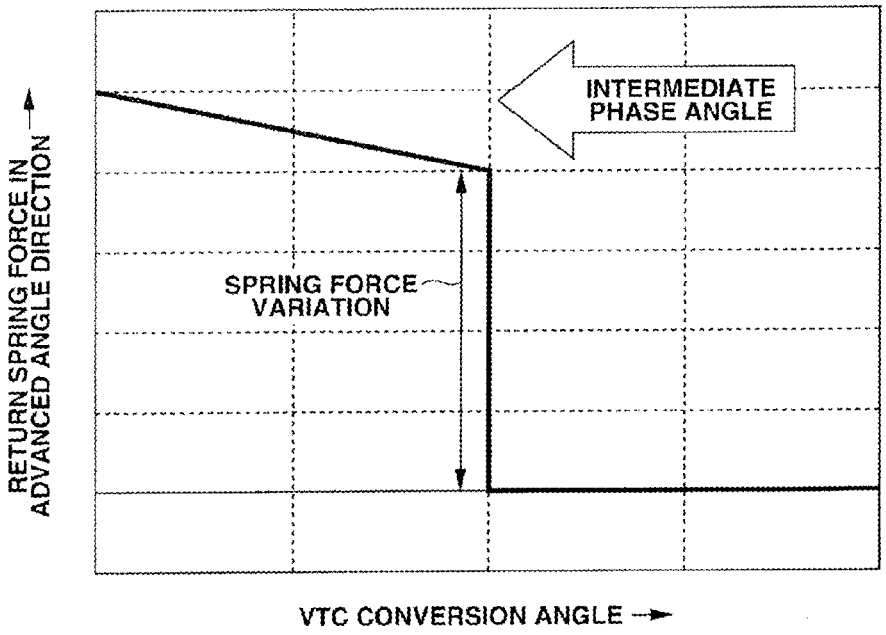
FIG. 5 is a characteristic graph showing a relationship between a conversion angle of the cam shaft and a return spring force in an advance angle direction, in the valve timing control apparatus of FIG. 1.

FIG. 5 shows a variation of the spring force of torsion spring 51 during the relative rotation of cam shaft 2 in the advance angle direction and in the retard angle direction. The spring force of torsion spring 51 provided with the set load is acted from the above-described most retard angle position to the intermediate phase position. However, when cam shaft 2 reaches the intermediate phase position, the set load is released, and the spring force is instantaneously decreased to zero.

Figure 6:
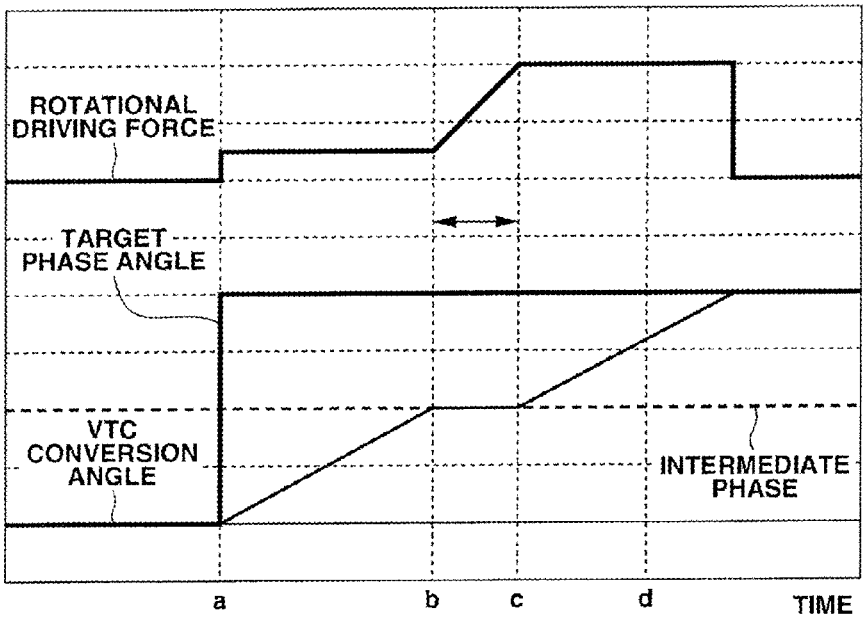
FIG. 6 is a time chart showing a relationship between the conversion angle of the cam shaft from the most retard angle position to the most advance angle position, and a driving force by a spring, in the valve timing control apparatus of FIG. 1.

FIG. 6 shows a time chart of the rotational driving force of electric motor 2, a target relative angle, and an actual relative rotational angle when cam shaft 2 is relatively rotated from the most retard angle position to the most advance angle position.

From this drawing, when the control unit sets the target phase angle to the most advance angle side at a point a in FIG. 6, electric motor 12 is energized to drive and rotate driven member 9 (cam shaft 2) to the target phase angle through speed reduction mechanism 8. At this time, the rotational driving force (the supply amount of the current)

becomes extremely small by the assist spring force of torsion spring 51 although the friction of the various portions is generated until a point b in FIG. 6.

Then, when cam shaft 2 is rotated in the advance angle direction and reaches the point b in FIG. 6, that is, cam shaft 2 is positioned at the intermediate phase position, the assist spring force of torsion spring 51 is released by the above-described actuation. Accordingly, the driving load of electric motor 12 becomes large from this time. Consequently, the control unit supplies the large amount of the current, and the rotational driving force of electric motor 12 is suddenly increased until a point c in FIG. 6.

Next, cam shaft 2 is relatively rotated to a point d in FIG. 6 which is the most advance angle position by the large rotational driving force of electric motor 12.

Figure 7:
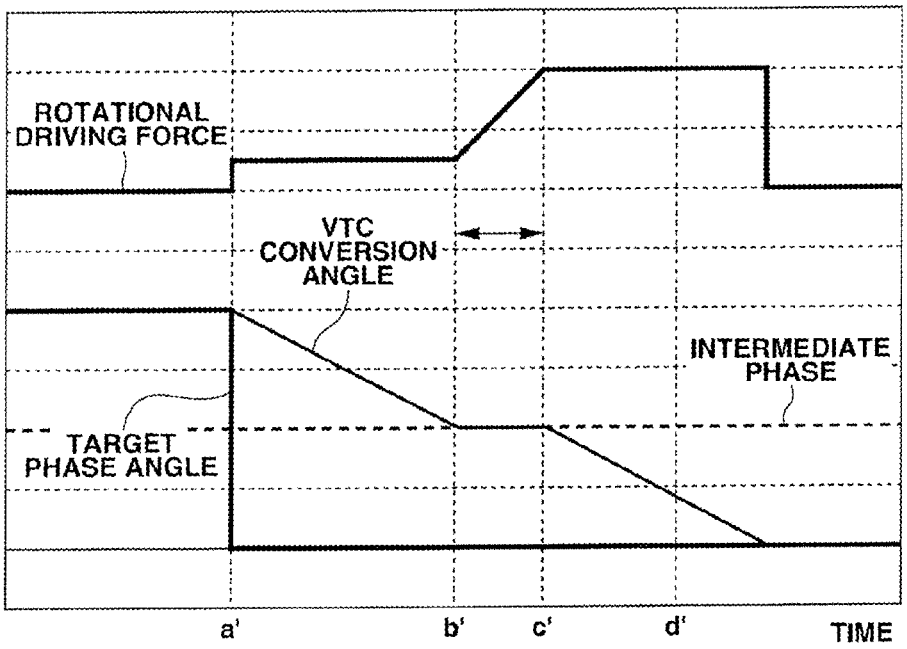
FIG. 7 is a time chart showing a relationship between the conversion angle of the cam shaft from the most advance angle position to the most retard angle position, and the driving force by the spring, in the valve timing control apparatus of FIG. 1.

FIG. 7 shows a phase conversion opposite to the case of FIG. 6. FIG. 7 shows a case in which cam shaft 2 is converted from the most advance angle position to the most retard angle position. When the control unit sets the target phase angle to the most retard angel side at a point a' in FIG. 7, electric motor 12 is energized to drive and rotate driven member 9 (cam shaft 2) to the target phase angle through speed reduction mechanism 8. At this time (In this case), the rotational driving force of electric motor 12 becomes relatively small until a point b' in FIG. 7 by the driving friction (the alternating torque) of cam shaft 2.

Then, when cam shaft 2 is rotated in the retard angle direction and reaches the point b' in FIG. 7, that is, cam shaft 2 is positioned at the intermediate phase position, the spring force of torsion spring 51 is instantaneously acted as the reaction force. Accordingly, the rotational driving force of electric motor 12 suddenly becomes large until a point c' in FIG. 7.

Next, cam shaft 2 is relatively rotated to a point d' in FIG. 7 which is the most retard angle position by the large rotational driving force of electric motor 12 against the spring force of torsion spring 51.

The control unit senses, as the intermediate phase position, a timing at which the spring force of torsion spring 51 shown in FIG. 5 is largely varied, that is, a timing at which the control unit senses the large variation of the rotational driving force of electric motor 12 from the points b, b' in FIGS. 6 and 7 to the points c, c' in FIGS. 6 and 7. That is, the control unit senses the variation point of the T5 driving load of electric motor 12 as the intermediate phase position.

Accordingly, it is possible to accurately and rapidly sense the intermediate phase position of cam shaft 2 relative to timing sprocket 1.

Consequently, it is possible to improve the response of the control of the valve timing, in particular, at the cold engine start, and thereby to obtain the good start characteristic (good startability). Moreover, it is possible to largely reduce the cost since the sensor having the high sensing accuracy need not be used.

Besides, the control unit senses the intermediate phase position in the normal driving state of the engine, in addition to the stop of the engine, or the engine start, in particular, the cranking during the cold engine start.

Moreover, at the start and the stop of the engine, it is difficult to hold the valve timing control apparatus to the constant phase since the alternating torque variation generated in cam shaft 2 is large. However, in this embodiment, the rotational driving force by which cam shaft 2 is not converted in the retard angle direction at the intermediate phase position is applied. With this, cam shaft 2 is pressed in the both directions by the spring force of torsion spring 51 in the advance angle direction and the rotational driving force of electric motor 12. Accordingly, it is possible to surely and stably hold to the intermediate phase position with respect to the alternating torque variation.

Second Embodiment

Figure 8A:
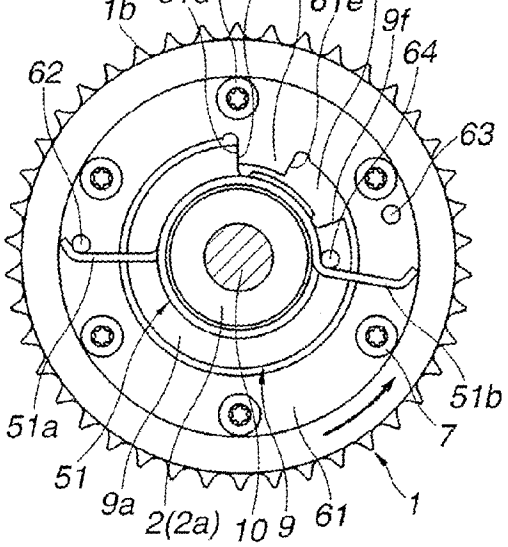
FIGS. 8A, 8B, and 8C are views showing an operation state of a valve timing control apparatus according to a second embodiment of the present invention.
Figure 8B:
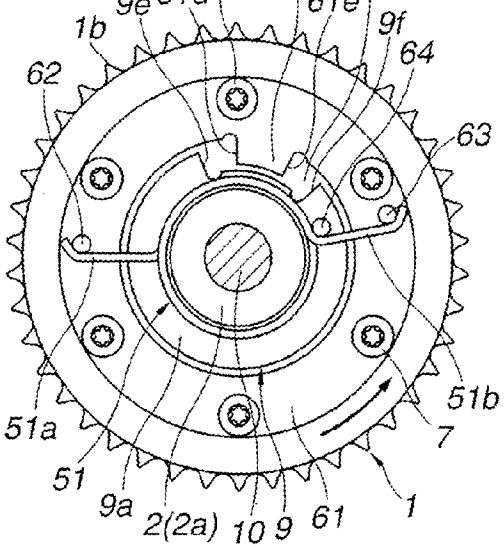
Figure 8C:
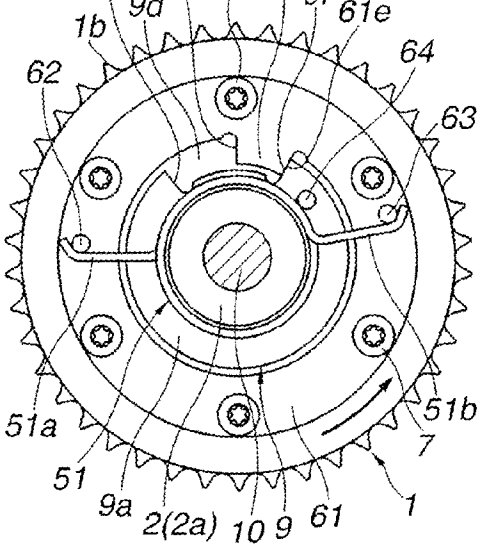

FIGS. 8A-8C show a valve timing control apparatus according to a second embodiment of the present invention. In this second embodiment, a retaining structure of both end portions 51*a* and 51*b* of torsion spring 51 is varied.

That is, holding plate 61 includes two first and second retaining pins 62 and 63 which are disposed on the outer surface of holding plate 61 on the timing sprocket 1's side to protrude. First and second retaining pins 62 and 63 are arranged to elastically hold, in the circumferential direction, both end portions 51*a* and 51*b* of torsion spring 51 which are bent in the radially outward directions.

On the other hand, driven member 9 includes fixing end portion 9*a* which has a disc shape having a large thickness; and an arc hole 9*d* which is identical to that of the first embodiment, and which is formed in fixing end portion 9*a*. Both end edges 9*e* and 9*f* of arc hole 9*d* of driven member 9 are relatively abutted on both side surfaces 61*d* and 61*e* of stopper raised portion 61*b* of holding plate 61 to restrict the most retard angle position and the most advance angle position of cam shaft 2.

A third retaining pin 64 is provided at a portion of fixing end portion 9*a* near second retaining pin 63 to protrude.

Torsion spring 51 includes a first end portion 51*a* which constantly elastically supported on first retaining pin 62 toward the most retard angle position; and a second end portion 51*b* which having a base end portion side elastically supported on third retaining pin 64 toward the most advance angle position while cam shaft 2 is relatively rotated from the most retard angle position shown in FIG. 8A to the intermediate phase position shown in FIG. 8B, and which is elastically supported by third retaining pin 64 and second retaining pin 63 at the intermediate phase position of cam shaft 2.

Moreover, when cam shaft 2 is relatively rotated from the intermediate phase position to the most advance angle position as shown in FIG. 8C, the tip end portion of second end portion 51*b* of torsion spring 51 is elastically supported only by second retaining pin 63.

That is, torsion spring 51 is set so as to apply the spring force in the advance angle direction to cam shaft 2 through driven member 9 in a region where cam shaft 2 is relatively rotated from the most retard angle position to the intermediate phase position, and to release the spring force at the intermediate phase position so as not to act the spring force in the advance angle direction to cam shaft 2 in a region where cam shaft 2 is relatively rotated from the intermediate phase position to the most advance angle position, as shown in FIG. 5, like the first embodiment.

Accordingly, in this second embodiment, the rotational driving force of electric motor 12 becomes extremely small by the assist spring force of torsion spring 51 from the most retard angle position of cam shaft 2 to the intermediate phase position of cam shaft 2, as shown in FIG. 6. The rotational driving force of electric motor 12 suddenly becomes large when cam shaft 2 is relatively rotated from the intermediate phase position in the advance angle direction, as shown in FIG. 6.

Moreover, when cam shaft 2 is relatively rotated from the most advance angle position to the most retard angle position, the variation of the rotational driving force of electric motor 12 is generated as shown in FIG. 7. Accordingly, the control unit can rapidly accurately sense the intermediate phase position based on this variation of the rotational driving force of electric motor 12.

Accordingly, in this second embodiment, it is possible to attain the effects and the functions which are identical to those of the first embodiment.

The present invention is not limited to the structures according to the embodiments. For example, the spring set load of torsion spring 51 can arbitrarily vary in accordance with the specification and the size of the valve timing control apparatus.

Moreover, the thickness of inner wall 47*a* of middle diameter ball bearing 47 in the circumferential direction may be varied as the eccentric shaft portion to be eccentric with respect to the shaft center of ball bearing 47. In this case, eccentric shaft portion 39 may be omitted, and motor output shaft 13 may be formed to further extend. Alternatively, eccentric shaft portion 39 may be formed into a concentric cylindrical shape.

[a] In the valve timing control apparatus of the internal combustion engine according to the embodiments of the present invention, the urging member is arranged to urge in the advance angle direction between the most retard angle position and the intermediate phase position.

[b] In the valve timing control apparatus of the internal combustion engine according to the embodiments of the present invention, the controller calculates the relative rotational speed by a sensed value of a crank angle sensor and a sensed value of a cam angle sensor.

[c] In the valve timing control apparatus of the internal combustion engine according to the embodiments of the present invention, the controller corrects a control value in consideration of the urging force of the urging member from the one of the most retard angle position and the most advance angle position to the intermediate phase position, with respect to a region between the other of the most retard angle position and the most advance angle position and the intermediate phase position.

[d] In the valve timing control apparatus of the internal combustion engine according to the embodiments of the present invention, the cam shaft is rotated relative to the driving rotational member by a power directly generated by an electric actuator.

[e] In the valve timing control apparatus of the internal combustion engine according to the embodiments of the present invention, the controller senses the intermediate phase position at a cranking when the engine is started.

[f] In the valve timing control apparatus of the internal combustion engine according to the embodiments of the present invention, the engine is stopped after the controller controls to the intermediate phase position.

[g] In the valve timing control apparatus according to the embodiments of the present invention, at the cranking of the engine, the controller checks a position at the cranking of the engine by applying an actuation force which is equal to or smaller than the set load in a direction against the urging force of the urging member.

[h] In the valve timing control apparatus according to the embodiments of the present invention, the controller actuates in the retard angle direction than the intermediate phase position at the cranking when a temperature of the engine is equal to or greater than a predetermined temperature.

By the control apparatus of the valve timing control apparatus according to the embodiments of the present invention, for the engine start after the engine warm-up, it is possible to rapidly relatively rotate the cam shaft in the retard angle side while suppressing the generation of the abnormal combustion (pre-ignition), and improve the start characteristic (startability).

[i] In the controller of the valve timing control apparatus according to the embodiments of the present invention, the controller actuates toward the most retard angle side at a maximum relative rotational speed when the cam shaft is actuated from the intermediate phase position in the retard angle direction at the cranking.

The rapid relative rotation is obtained by increasing the driving force of the relative rotation with respect to the cam shaft.

[j] In the controller of the valve timing control apparatus according to the embodiments of the present invention, the urging force of the urging member is larger than an to average value of an alternating torque generated in the cam shaft.

The urging force of the urging member overcomes the alternating torque generated in the cam shaft, and thereby surely relatively rotates the cam shaft in the return direction.

The entire contents of Japanese Patent Application No. 2012-205135 filed Sep. 19, 2012 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve timing control apparatus of an internal combustion engine comprising:

a driving rotational member to which a rotational force is transmitted from a crank shaft;

a cam shaft arranged to be rotated relative to the driving rotational member in accordance with a state of the engine from a most retard angle position to a most advance angle position through an intermediate phase position which is set between the most retard angle position and the most advance angle position, and which is appropriate for a start of the engine;

an urging member to which a set load is provided to act, to the cam shaft, an urging force from one of the most retard angle position and the most advance angle position toward the intermediate phase position; and a controller configured to sense, as the intermediate phase position, a position at which a relative rotational speed between the driving rotational member and the cam shaft is varied by the relative rotation of the cam shaft beyond a region in which the cam shaft is controlled by the set load of the urging member, when the cam shaft is controlled to be relatively rotated from the one of the most retard angle position and the most advance angle position beyond the intermediate phase position.

2. The valve timing control apparatus as claimed in claim 1, wherein the urging member is arranged to urge in the advance angle direction between the most retard angle position and the intermediate phase position.

3. The valve timing control apparatus as claimed in claim 1, wherein the controller calculates the relative rotational speed by a sensed value of a crank angle sensor and a sensed value of a cam angle sensor.

4. The valve timing control apparatus as claimed in claim 1, wherein the controller corrects a control value in consideration of the urging force of the urging member from the one of the most retard angle position and the most advance angle position to the intermediate phase position, with respect to a region between the other of the most retard angle position and the most advance angle position and the intermediate phase position.

5. The valve timing control apparatus as claimed in claim 2, wherein the cam shaft is rotated relative to the driving rotational member by a power directly generated by an electric actuator.

6. The valve timing control apparatus as claimed in claim 5, wherein the controller senses the intermediate phase position at a cranking when the engine is started.

7. The valve timing control apparatus as claimed in claim 6, wherein the engine is stopped after the controller controls to the intermediate phase position.

8. The valve timing control apparatus as claimed in claim 7, wherein the controller checks a position at the cranking of the engine by applying an actuation force which is equal to or smaller than the set load in a direction against the urging force of the urging member.

9. The valve timing control apparatus as claimed in claim 8, wherein the controller actuates in the retard angle direction than the intermediate phase position at the cranking when a temperature of the engine is equal to or greater than a predetermined temperature.

10. The valve timing control apparatus as claimed in claim 9, wherein the controller actuates toward the most retard angle side at a maximum relative rotational speed when the cam shaft is actuated from the intermediate phase position in the retard angle direction at the cranking.

11. The valve timing control apparatus as claimed in claim 2, wherein the urging force of the urging member is larger than an average value of an alternating torque generated in the cam shaft.

12. The valve timing control apparatus as claimed in claim 5, wherein the controller senses a variation of the relative rotational speed by a variation of a rotational driving force of the electric actuator.

13. The valve timing control apparatus as claimed in claim 12, wherein the controller senses a variation of the rotational driving force of the electric actuator by sensing a current supplied to the electric actuator.

14. The valve timing control apparatus as claimed in claim 2, wherein the urging member is a torsion spring; and the torsion spring includes a first end portion retained by the cam shaft, and a second end portion inserted and engaged in an engagement groove of the driving rotational member.

15. The valve timing control apparatus as claimed in claim 14, wherein the second end portion of the torsion spring is elastically abutted on one end edge of the engagement groove in the circumferential direction between the most retard angle position and the intermediate phase position of the cam shaft; and the torsion spring applies, to the cam shaft, a predetermined spring set load toward the advance angle side.

16. The valve timing control apparatus as claimed in claim 15, wherein when the cam shaft is rotated in the advance angel direction toward a predetermined angle position, the torsion spring is separated from the one end edge of the engagement groove so as to release the spring set load.

17. The valve timing control apparatus as claimed in claim 2, wherein the urging member is a torsion spring including a first end portion and a second end portion; the driving rotational member includes a first retaining pin which elastically supports the first end portion of the torsion spring toward the most retard angle position, a second retaining pin which elastically supports the second end portion of the torsion spring toward the most advance angle position when the cam shaft is relatively rotated from the intermediate phase position to the most advance angle position; and the cam shaft includes a third retaining pin which elastically supports the second end portion of the torsion spring toward the most advance angle position when the cam shaft is relatively rotated from the most retard angle position to the intermediate phase position.

18. The valve timing control apparatus as claimed in claim 17, wherein the first end portion of the torsion spring is constantly elastically supported by the first retaining pin toward the most retard angle position; the second end portion of the torsion spring includes a base end portion elastically supported by the third retaining pin toward the most advance angle position while the cam shaft is relatively rotated from the most retard angle position to the intermediate phase position; and the second end portion of the torsion spring is elastically supported by the third retaining pin and the second retaining pin at the intermediate phase position.

* * * * *